United States Patent [19]

Beghin

[11] 3,962,984

[45] June 15, 1976

[54] METHOD OF COMBINED NAVIGATION OF A BARGE OR A LIGHTER ON SEA AND INLAND WATERS AND APPARATUS FOR CARRYING OUT THE SAID METHOD

[75] Inventor: Michel Charles Marie Beghin, Meudon, France

[73] Assignee: Societe Nouvelle B.I.P.T. (Bureau International de Prestations Techniques), Ville d'Avray, France

[22] Filed: Apr. 11, 1975

[21] Appl. No.: 567,131

[30] Foreign Application Priority Data

Apr. 12, 1974 France ..... 74.13058

[52] U.S. Cl. ..... 115/17; 114/43.5 VC; 114/77 A; 115/.5 R; 115/34 R; 115/41 R; 114/235 R

[51] Int. Cl.[2] ..... B63H 5/00

[58] Field of Search ..... 115/.5 R, 17, 18 R, 115/34 R, 35, 37, 41 R, 41 HT; 114/77 R, 77 A, 43.5 VC, 43.5 R, 71, 189, 235 R, 235 A

[56] References Cited

UNITED STATES PATENTS

| | | | |
|---|---|---|---|
| 498,036 | 5/1893 | Snell | 115/.5 R |
| 685,591 | 10/1901 | Fernez et al. | 115/17 |
| 1,069,692 | 8/1913 | Harrison | 114/77 A |
| 2,057,995 | 10/1936 | Badovici | 114/43.5 VC |
| 2,371,149 | 3/1945 | Bylo | 114/77 R |

FOREIGN PATENTS OR APPLICATIONS

| | | | |
|---|---|---|---|
| 22,039 | 4/1911 | United Kingdom | 114/43.5 R |

*Primary Examiner*—Stephen G. Kunin
*Assistant Examiner*—Charles E. Frankfort

[57] ABSTRACT

Method of navigation of a first barge on sea and/or on inland waters, consisting in securing to the first barge a removable propelling plant allowing the barge to navigate on the sea, the first barge being joined side by side with a second barge bearing the propelling plant which is subjected to a lateral displacement with respect to the two barges until it reaches a predetermined position on the first barge before being locked thereto.

9 Claims, 19 Drawing Figures

Fig: 1.
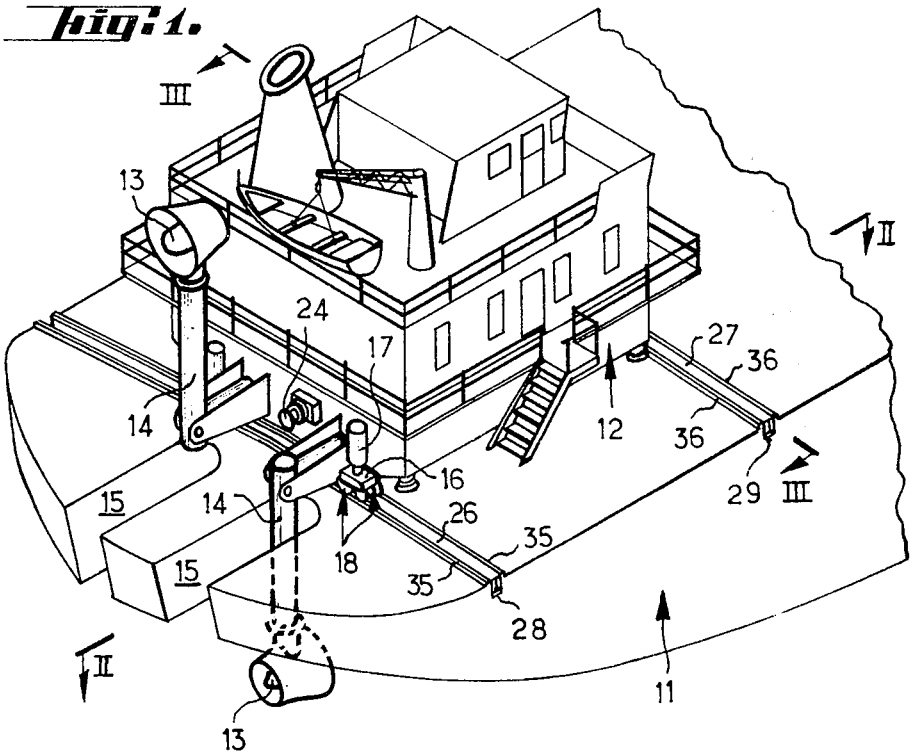
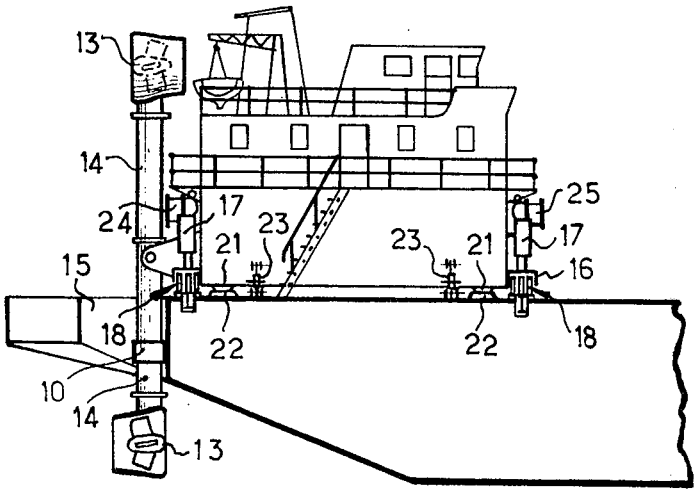
Fig: 2.

fig: 3.
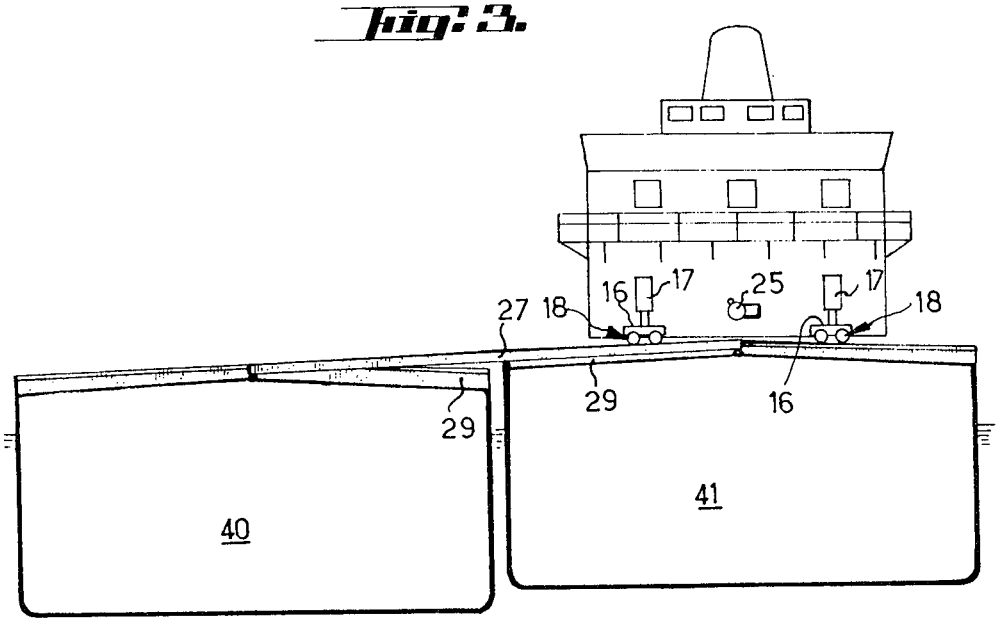
fig: 4.
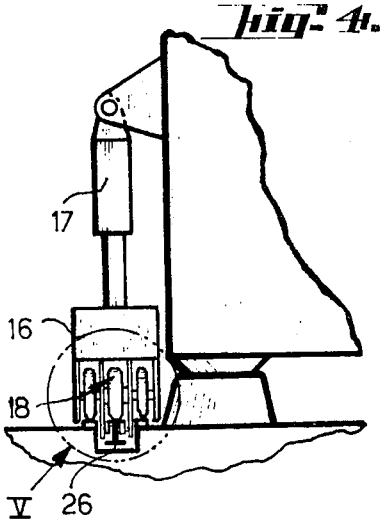
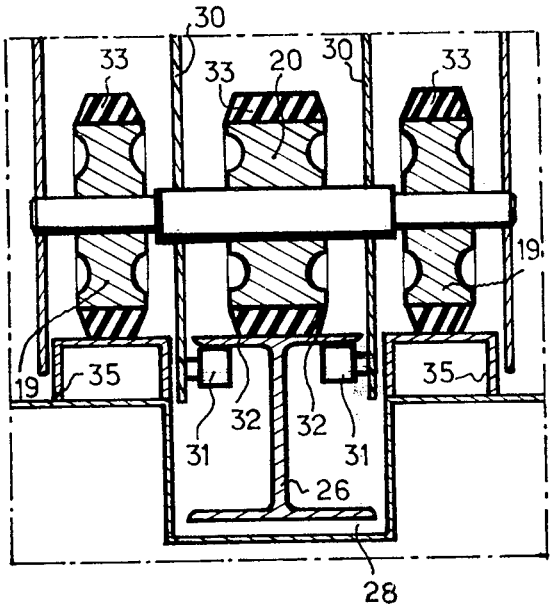
fig: 5.
fig: 6.
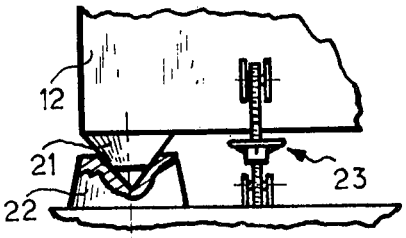

METHOD OF COMBINED NAVIGATION OF A BARGE OR A LIGHTER ON SEA AND INLAND WATERS AND APPARATUS FOR CARRYING OUT THE SAID METHOD

The present invention relates essentially to a method of combined navigation of barges, lighters or other boats having no means of propulsion of their own, on sea waters and inland waters such as rivers, channels or other water-courses. The invention also relates to several forms of embodiment of complete apparatus for carrying out the said method.

It is known that a barge of a conventional type can be made to navigate on quiet waters by conventional shoving or towage methods, but that the shoving of such a barge at sea presents difficulties and even dangers which entail complex and expensive installations. Moreover, the said installations permit the shoving of the barge only within certain limits of wave height, and this presents some additional dangers due to the risks of deterioration of the weather conditions during the passage.

The combined navigation method according to the present invention is essentially remarkable by the fact that it consists in doing away with the shoving or towage of the barge when the latter leaves the inland waters. To this end, the invention consists in fitting each barge having to confront the open sea with a separate and removable propelling plant allowing the said barge to move individually as any ship designed for sea navigation. For this reason, the said plant may comprise the crew fittings, the wheel-house and the safey appliances required by the maritime navigation rules.

More particularly, the invention relates to a method of combined navigation of a first barge or lighter at sea and on inland waters, the said barge being shoved or towed when being on the inland waters, characterized in that it consists, in order to allow the said barge to navigate on the sea, in securing on the said barge, for example on the after-deck thereof, a removable propelling plant from a second barge.

According to another feature of the method of the present invention, the said propelling plant from the second barge may be stored momentarily on a suitable storage area or a lifting or like device.

Lastly, the invention also relates to an apparatus for combined navigation of a barge or lighter on the sea and on inland waters, for carrying out the aforesaid method, characterized in that it is essentially composed of a removable propelling plant comprising transfer means and anchoring means, of complementary transfer means and complementary anchoring means, the said transfer means being adapted to co-operate with the said complementary transfer means and the said anchoring means being adapted to co-operate with the said complementary anchoring means secured to the said barge.

By transfer means and anchoring means are meant all the devices and structural elements attached to the removable propelling plant and necessary to transfer or anchor the latter, respectively, on the barge deck. By complementary transfer means and complementary anchoring means are meant all the devices and structural elements mounted outside the said propelling plant and co-operating for the transfer or the anchoring, respectively.

The invention will be better understood and other purposes, details and advantages of the latter will appear more clearly from the following explanatory description of several embodiments of the method according to the present invention and several systems and apparatus for carrying out the said method, given by way of example and made with reference to the appended drawings wherein:

FIG. 1 is a perspective view of the aft part of a barge adapted for combined navigation and on which is mounted an apparatus and more particularly a removable propelling plant according to the present invention;

FIG. 2 is a sectional view upon II—II of FIG. 1;

FIG. 3 shows two barges provided with equipments according to the present invention, joined to one another side by side, identical with the barge of FIG. 1 and shown in cross-section upon III—III of FIG. 1, and illustrates an operation for the transfer of the propelling plant from one barge onto the other;

FIG. 4 is a detailed view, to a larger scale, of the propelling plant, showing one of the devices forming a wheel-train or set of wheels;

FIG. 5 is an enlarged view of the encircled portion V of FIG. 4;

FIG. 6 is a detailed view of the propelling plant to the same scale as in FIG. 4 and partially broken away, showing a portion of the anchoring means and the complementary anchoring means as well as one of the locking devices;

Figure 7:
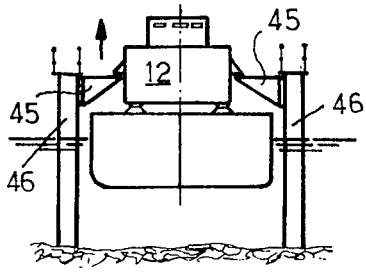

FIGS. 7, 8, 9, 10 and 11 diagrammatically illustrate other devices and apparatus according to the present invention for transferring and/or securing a propelling plant on a barge; and FIGS. 12 to 19 illustrate an operation for the transfer of another form of embodiment of the propelling plant between two barges joined to one another side by side.

Referring more particularly to FIGS. 1 and 2, there is shown the stern of a barge or lighter 11 provided with the equipments necessary to accommodate a removable propelling plant 12 which, in FIGS. 1 and 2, is shown mounted in its place. The propelling plant 12 comprises one or several Diesel engines (not shown) provided with their reducing gears and transmission elements, but it also comprises all the equipments and installations necessary for sea navigation and comfort for the crew members, i.e. the wheel-house equipped with all the navigation appliances, the crew cabins and so forth. The propelling plant 12 is also equipped with a raisable transmission system known under the name of "Z-Drive" which, therefore, does not form part of the present invention. The said raisable transmission system is double and comprises two propellers 13 shifted symmetrically with respect to the medical plane of the barge. The said propellers are driven by the said engine or engines, which are independent. Thus, the barge can be steered by adjusting the relative speeds of the two propellers and/or by causing them to pivot horizontally. The two transmission arms 14 can be raised (both possible positions are shown in FIGS. 1 and 2), this being indispensable, in the type of barge illustrated, to perform the transfer of the propelling plant from one barge onto the other. When the propelling plant operates, the arms 14 pass through two large cuts 15 provided in the aft part of the barge 11. Retaining and thrust-transfer devices 10 are provided at the bottom of the said cuts. The propelling plant 12 differs in particular from a ship's after-deck by the fact that it comprises several devices 16 forming a "wheel-train" or set of wheels, secured along its two transverse faces and each including an actuating cylinder 17; the wheel-train is secured to the wall of the propelling plant through the medium of the said cylinder, thus allowing for vertical displacement of the wheel-train with respect to the said propelling plant. Each wheel-train comprises two sets 18 of three coaxial wheels, the axes of each of the said sets being parallel with the longitudinal centre-line of the barge. Each said set of wheels comprises two outer wheels 19 and an inner wheel 20. These wheels are advantageously provided with rubber bands, tyres or the like 33 improving the adherence. Moreover, the propelling plant 12 rests upon the after-deck of the barge through the medium of supporting and centering cones 21 which constitute the aforesaid anchoring means, embedded in hollow supports or sockets 22 of a complementary shape, forming the aforesaid complementary anchoring means secured to the after-deck. Several manual locking screw-jacks 23 ensure a permanent and firm connection between the propelling plant and the barge, preventing in particular the said plant 12 from being raised momentarily under the action of a sea. FIG. 6 shows a detailed view of one of the supporting and centering cones 21 embedded in the corresponding support 22 and of one of the screw-jacks 23 ensuring the manual locking. Lastly, the presence should be noted on the plant 12 of two so-called "shifting" or "sliding" winches owing to which the translation of the propelling plant from one barge onto the other can be performed.

Two movable beams 26 and 27 constituted by an I-section are normally accommodated transversely of the barge in grooves or recesses 28 and 29, respectively. FIGS. 4 and 5 show more clearly the arrangement of the beam 26 with respect to the associated devices forming the wheel-train 16. The beam 27 is mounted likewise. It is seen that the wheel-train 16 comprises two internal uprights 30 on either side of the aforesaid inner wheels 20. To the lower portion of each of the said uprights is secured a freely rotating roller 31 located within the space defined by the two uprights 30; owing to this fact, the said roller can come into rolling contact with the internal face 32 of the corresponding horizontal, longitudinally continuous surface formed by the very I-section structure of the beam 26. This feature therefore renders the position of the beam dependent upon the relative motions of the actuating cylinders 17 to which the wheel-trains are connected.

The whole set of wheel-trains 16 and movable beams 26 and 27 constitutes the afore-mentioned transfer means for the propelling plant. The complementary transfer means are constituted by two rails 35 secured transversely on the after-deck of the barge, on either side of the transverse groove 28 and by two rails 36 secured in the same manner on either side of the transverse groove 29. These rails are formed by simple U-sections and the spacing between the couples of rails 35 and the couples of rails 36 is so selected that the outer wheels 19 of the corresponding wheel-trains 16 can bear upon and move on these rails, whereas the inner wheels 20 are adapted to move along the movable beams 26 or 27, respectively. The whole set of movable beams and stationary rails arranged on either side of the said beams thus constitutes a guiding structure along which the propelling plant 12 will be able to move for its translation transversely from one barge onto the other according to a sequence of operations which will now be described.

FIG. 3 illustrates the transfer operation proper and shows more particularly the completion of the transfer of the propelling plant 12 from a barge 40 towards a barge 41 adjoined thereto. The said barges are identical with the barge 11 and represented in cross-section substantially upon III—III of FIG. 1. The reference numerals relating to the propelling plant and to the aforesaid guiding structure are the same as in FIGS. 1 and 2. It is clearly seen that during the transfer operation, the movable beams 26, 27 rest by their ends upon both barges 40 and 41, each of the said ends resting upon one of the barges at a point located in proximity to the medial longitudinal plane of the latter. In this manner, the list of the barges 40–41 during the transfer operation is avoided or reduced. The interesting feature just mentioned presupposes, of course, that the length of each beam is substantially equal to the width of one of the barges. Moreover, as shown in FIG. 3, the method according to the present invention is applicable even if the draught of the barge 40 is greater than that of the barge 41. By way of example, for barges of 16 meters in width, between which is performed a transfer of a propelling plant weighting between 80 and 100 tons, an authorized maximum draught difference will be comprised between 1.30 m and 1.60 m, which corresponds to a rolling slope (inclination of the movable beams) of about 10%.

The method according to the present invention is carried out as follows.

The two barges 40 and 41 are brought into mutual lateral contact as appears from FIG. 3, the barge 40 carrying the propelling plant 12 at the beginning of the operation. As long as the propelling plant is in operation on the barge 40, the wheels of the various wheel-trains 16 rest by their own weight upon the guiding structure of the said barge. The first operation consists in hydraulically lifting to a certain height, by means of the actuators, the wheel-trains 16 so that the beams 26–27 be raised out of their grooves 28–29 by the rollers 31. In this manner, the beams can have access to the deck of the next barge 41 even if the later is higher than the deck of the barge 40. The beams are then drawn towards the barge 41 and secured in the position shown in FIG. 3. When the movable beams are put in place, the winches 24–25 are then used for the transfer or "shifting". To this end, the wheels are hydraulically moved to their lower position after the manual locking screw-jacks 23 are released and the transmission arms 14 are raised. The propelling plant 12 then rises, the anchoring means separate from the complementary anchoring means and the plant 12 can be pulled from the barge 40 towards the barge 41 along the guiding structure, through the medium of the winches 24–25. It should be noted that during the transfer the wheel-trains 16 roll either on the outer couples of rails 35 and 36, owing to the outer wheels 19, or on the movable beams 26 or 27 owing to the inner wheels 20. Moreover, the winches 24–25 can be used to exert a pulling action as well as a retaining action depending upon the direction of the slope. Lastly, a trim difference between the two barges is not troublesome since the movable beams are independent and hinged at their point of support; in such an event, the actuators simply fulfill the additional function of a telescopic suspension by way of manual or automatic adjustment of the lengths of the rods of the front and rear actuators, depending upon the trim difference.

When the propelling plant 12 is in the required position on the barge 41, the pressure in the actuating cylinders is released and the said plant is slightly laid down on the barge deck and is positioned by the cones 21 and the sockets 22; the propelling plant is then firmly secured in that position by closing the screw-jacks 23. When the propelling plant 12 is thus mounted on the barge 41, the wheel-trains are raised, thus causing the beams 26-27 to be again raised owing to the function fulfilled by the rollers 31. It is then possible, by means of, for example, the winches 24–25 to make the beams roll to their position of rest in the transverse grooves 28–29 of the barge 41. Thus, the movable beams are always on board the barge which is equipped with the propelling plant. Lastly, the transmission arms 14 are lowered and the barge 41 is then ready to navigate on the sea by its own means. It should finally be noted that if it is desired, for some reason or another, to limit the relative variation of the draughts during the transfer operation (for example with a view to reducing the tensile stresses in the propelling plant 12 during the said transfer operation), a differential ballasting of the two barges may be performed, for example by causing a certain amount of water corresponding substantially to the mass of the propelling plant 12 to pass progressively from the barge 41 towards the barge 40 during the transfer operation. This can be achieved, for example, by means of an arrangement (not shown) of pumps, conduits and valves whereby a water ballast on barge 41 is tapped to transfer the desired amount to barge 40 as the propelling plant is transferred from barge 40 to barge 41.

Figure 8:
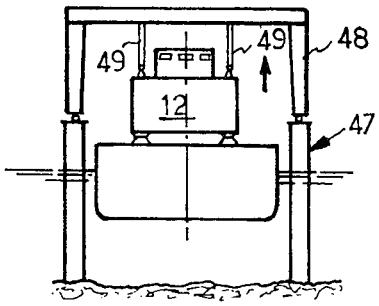
Figure 9:
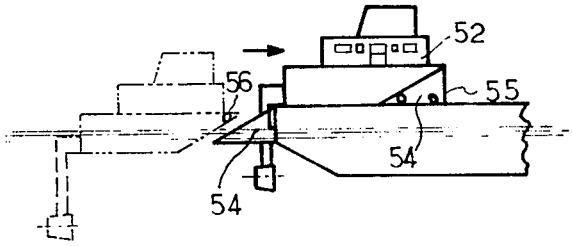
Figure 10:
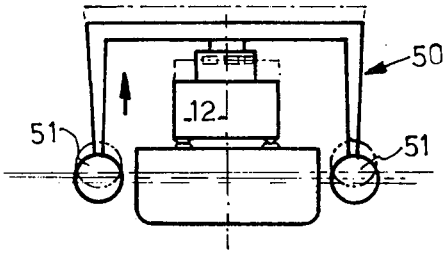
Figure 11:
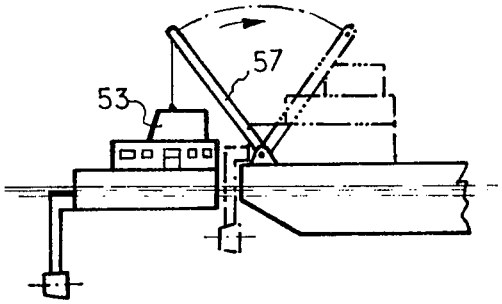
Figure 12:
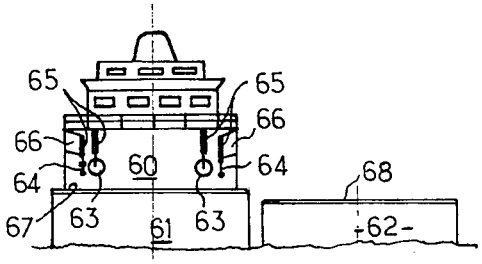

The foregoing description relates to a preferred method and a preferred operating mode according to the present invention. The latter is by no means limited to a direct transfer or "shifting" from one barge to another. In particular, it is contemplated to momentarily store one or several propelling plants on special devices or storage areas specially adapted for the purpose. The said special devices may also be used for mounting the plant 12 on a given barge. For example, use can be made of apparatus according to FIGS. 7 or 8, wherein the propelling plant 12 is supported by a system of brackets 45 which in this case constitute the complementary transfer means according to the foregoing definition, mounted on stationary masts or posts 46 (FIG. 7), or by a stationary installation 47 comprising a portal forming a gantry for a travelling train 48 (complementary transfer means) provided with winches 49 (FIG. 8). FIG. 10 shows another form of embodiment comprising a floating portal 50 supported by floats 51, the ballasting of which is variable and adjustable, thus allowing the use of a winch to be dispensed with. In these examples, the devices described previously and illustrated in FIGS. 1 to 8, may coexist for a subsequent transfer from one barge to another. Lastly, FIGS. 9 to 11 illustrate another way of carrying out the transfer, in which the propelling plant 52 or 53 used is adapted to float and move by its own means from one barge to another. According to FIG. 9, the stern of the barge is provided with an inclined plane with a rack 54 whose upper portion 55 is movable in longitudinal translation and represented in its advanced position in FIG. 9. Moreover, the front of the propelling plant 52 is inclined and provided with gear wheels 56 owing to which, when reaching the stern of the barge, the said propelling plant is adapted to hoist itself up to the level of the after-deck of the barge and then be moved forward owing to the said portion 55. The locking of the propelling plant may be performed in any intermediate position of the forward displacement of the said portion 55, in order to carry out a correction of the air space if necessary. The inclined planes 54 may be retractable or removable.

FIG. 11 shows another form of embodiment, wherein the floating propelling plant 53 is hoisted on board the barge by a pivotable portal 57 mounted directly on the barge deck, the said pivotable portal itself being removable if appropriate. Of course, the equipments illustrated in FIGS. 1 to 6 may co-exist in this form of embodiment.

Lastly, FIGS. 12 to 19 illustrate the sequence of operations for direct transfer of a propelling plant 60 from a barge 61 onto a barge 62, the equipment of the said propelling assembly 60 and more particularly the arrangement of its stationary wheel-trains 63 and its pivotable wheel-trains 64 being so designed as to allow the said direct transfer to be performed without movable beam. The stationary wheel-trains 63 differ from those shown in FIGS. 1 to 5 by the fact that they do not necessarily comprise sets of coaxial wheels (19, 20), since the movable rail is done away with; on the other hand, they are provided with actuating cylinders 65 altogether comparable to the cylinders 17. The pivotable wheel-trains 64 are preferably identical with the wheel-trains 63, except for the simple fact that they are mounted on pivotable supports 66 and adapted to be locked in two positions, i.e. a retracted position (FIGS. 12 and 19) and an extended position (FIGS. 13 to 18). The transfer operations are as follows.

Figure 13:
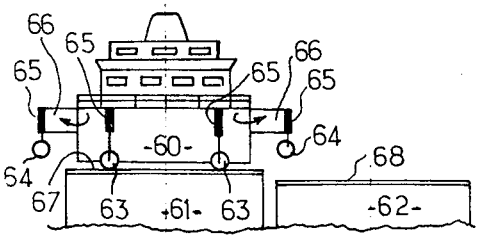
Figure 14:
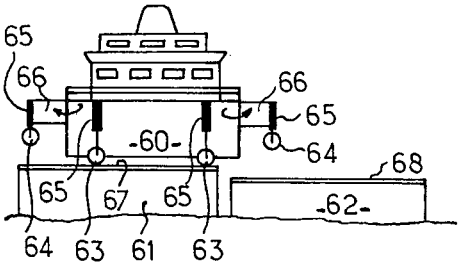
Figure 15:
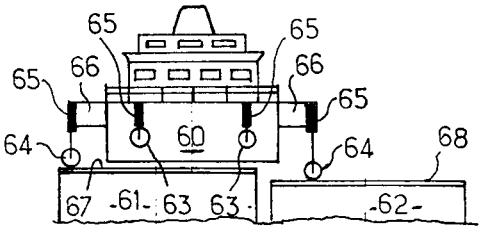
Figure 16:
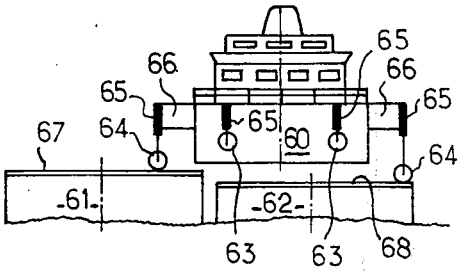
Figure 17:
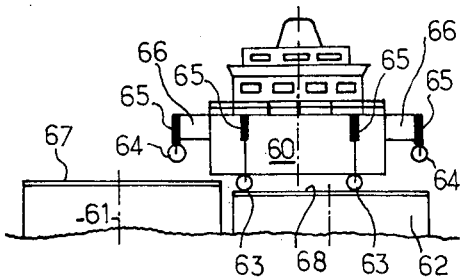
Figure 18:
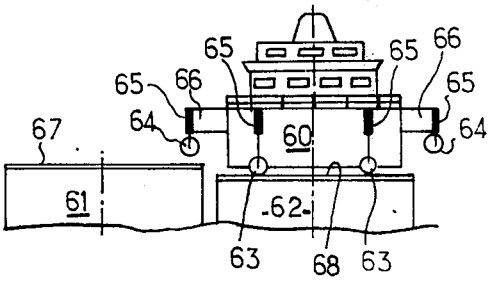
Figure 19:
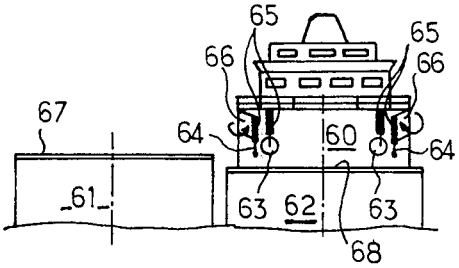

As long as the propelling plant 60 is operated on the barge 61, the supports 66 are in retracted position (FIG. 12) and the various actuating cylinders are not supplied with fluid under pressure. The propelling plant 60 is secured on the barge 61 through the medium of anchoring means (not shown) which may be for example of the type of those described previously. When the two barges 61 and 62 are joined together side by side in a suitable position for the transfer operation, the pivotable supports 66 are extended and the propelling plant 60 is raised with respect to the deck of the barge 61 owing to the actuation of the cylinders 65 of the wheel-trains 63 (FIG. 13). The transfer of the propelling plant can be then be started, the latter bearing upon the rails 67 secured to the deck of the barge 61, through the medium of wheel-trains 63 (FIG. 14), and then through the medium of the wheel-trains 64 (FIG. 15), some of which then rest upon the guiding rails 68 of the barge 62. The transfer thus continues (FIG. 16) until all the wheel-trains 63 are again apt to ensure the translation, by now rolling on the deck of the barge 62 (FIG. 17) and until the propelling plant 60 reaches the required position (FIG. 18) on the barge 62. The pressure in the cylinders 65 is then released and the supports 66 are moved back to their retracted position (FIG. 19); the transfer is thus completed.

Of course, the invention is by no means limited to the forms of embodiment which have just been described and which have been given only by way of example. It is clear, in particular, that a great number of improvements can be brought to the equipments and devices described briefly with reference to FIGS. 7 to 19, without departing from the scope of the present invention. For example, there has been illustrated a propelling plant provided with raisable transmission members, but a propelling plant can also be contemplated (especially for high powers) which does not offer this advantageous feature; it will however be possible to adapt it on barges having a truncated aft part and deprived of the above-mentioned wide cuts. Moreover, it is perfectly possible (in the case of the equipment represented in FIGS. 1 to 5) to dispense with the actuating cylinders 17 which complicate the installation; it is then sufficient to provide for only three wheel-trains in triangular arrangement so as to avoid the difficulties resulting from the possible presence of a trim difference between the two barges. The telescopic correction performed previously by the cylinders thus becomes useless and the transverse displacement is made possible by providing retractable anchoring means and/or complementary anchoring means. The stationary (or the movable) rails may have quite different profiles; more particularly, a U-shaped profile of the movable beams may perfectly be contemplated, thus making useless the lateral wheels of each wheel-train. Lastly, the propelling assembly itself may have quite variabe shape and dimensions; in particular, it is possible to mount on the barges propelling plants adapted for river navigation (limited height, arrangements corresponding to the inland navigation rules and so forth), and the barges so equipped may be used as a pusher for one or several other barge. The invention therefore comprises all technical equivalents to the means described, should the latter be used within the scope of the following claims.

What is claimed is:

1. Method of navigation of a first barge on sea and/or on inland waters, consisting, for the purpose of, for example, allowing the said first barge to navigate on the sea, in securing on the said barge, for example on the after-deck thereof, a removable propelling plant proceeding from a second barge, wherein the improvement consists in that the said first barge and the said second barge are substantially joined together side by side, the said removable propelling plant is detached from the said second barge and is then subjected to a lateral displacement with respect to the said two barges until it reaches a predetermined position on the said first barge before being locked on the latter in the said predetermined position.

2. Method according to claim 1, wherein, before the said lateral displacement of the propelling plant, at least two movable beams previously located on the said second barge are subjected to a longitudinal displacement transversely of the latter until the said beams reach a position in which they rest by their ends upon both barges, each of the said ends resting upon one of the barges, preferably at a point located substantially in the medial longitudinal plane thereof, and then, after the said lateral displacement of the propelling plant along the said beams is continued to a position of rest on the said first barge.

3. Method according to claim 1, including the step of causing a mass of water corresponding substantially to the mass of the propelling plant to pass progressively from said first barge to said second barge simultaneously with the lateral displacement of the propelling plant from said second barge to said first barge.

4. Apparatus for the navigation of a barge on sea and/or on inland waters, comprising a removable propelling plant having means thereon for tranferring same from one barge to another barge and for anchoring same to such other barge, complementary transferring and anchoring means on the other barge cooperable with said transferring and anchoring means on said propelling plant for transfer thereof from said one barge to the other barge and for anchoring the propelling plant on the other barge, the said transferring means being constituted by several devices forming wheel-trains secured to the base of said propelling plant and by at least two beams arranged transversely of the said other barge and movable along their longitudinal axes, the complementary transferring means being constituted by several stationary rails arranged transversely of the said other barge and secured thereto, the said beams and the said rails being so arranged as to form a guiding structure upon which the said devices forming wheel-trains can bear and along which they can move.

5. Apparatus according to claim 4, wherein the said devices forming wheel-trains are secured to the said propelling plant through the medium of hydraulic cylinders.

6. Apparatus according to claim 4, wherein each movable beam is embedded, when at rest, between two said stationary rails and each device forming a wheel-train includes at least one group of three coaxial wheels, the two outermost wheels being adapted to come into rolling contact with the two stationary rails and the central wheel being adapted to come into rolling contact with the movable beam.

7. Apparatus according to claim 6, comprising a connection between the devices forming the wheel-trains and the movable beam associated with the said devices, the said connection being constituted by at least one pair of coaxial rollers mounted at the lower portion of each device forming a wheel-train, the said rollers rotating freely and being adapted to come into rolling contact with the internal faces of the two horizontal, longitudinally continuous surfaces of the said associated movable beam.

8. Apparatus according to claim 4, wherein the said wheel-trains are three in number, and in triangular arrangement, and the anchoring means and the complementary anchoring means are retractable.

9. Apparatus for the navigation of a barge on sea and/or on inland waters, comprising a removable propelling plant having means thereon for transferring same from one barge to another barge, and for anchoring same to such other barge, complementary transferring and anchoring means on the other barge cooperable with said transferring and anchoring means on said propelling plant for transfer thereof from said one barge to the other barge and for anchoring of the propelling plant on the other barge, the said transferring means being constituted by several devices forming wheel-trains, hydraulic cylinders adapted to secure said several devices forming wheel-trains to the base of said propelling plant, additional devices forming wheel-trains secured on pivotable supports and hydraulic cylinders adapted to hingedly connect said additional devices to the sides of the propelling plant, the said complementary transferring means including several stationary rails arranged transversely of the said other barge and secured thereto.

* * * * *